US008043159B2

(12) United States Patent
Bae et al.

(10) Patent No.: US 8,043,159 B2
(45) Date of Patent: Oct. 25, 2011

(54) METHOD FOR PROVIDING LOCATION INFORMATION OF GAME CHARACTER BY OPERATING WITH MESSENGER SERVER AND SYSTEMS THEREOF

(75) Inventors: Soo Na Bae, Seoul (KR); Hyo Joon Kim, Kyunggi-do (KR)

(73) Assignee: NHN Corporation, Seongnam-si (KR)

( * ) Notice: Subject to any disclaimer, the term of this patent is extended or adjusted under 35 U.S.C. 154(b) by 589 days.

(21) Appl. No.: 11/568,341

(22) PCT Filed: May 6, 2005

(86) PCT No.: PCT/KR2005/001323

§ 371 (c)(1),
(2), (4) Date: Oct. 26, 2006

(87) PCT Pub. No.: WO2005/109272

PCT Pub. Date: Nov. 17, 2005

(65) Prior Publication Data

US 2007/0226307 A1 Sep. 27, 2007

(30) Foreign Application Priority Data

May 6, 2004 (KR) ..... 10-2004-0031586

(51) Int. Cl.
*A63F 9/24* (2006.01)

(52) U.S. Cl. ..... 463/42; 463/32

(58) Field of Classification Search ..... 463/30–40, 463/42

See application file for complete search history.

(56) References Cited

U.S. PATENT DOCUMENTS

| | | | | |
|---|---|---|---|---|
| 2002/0086732 | A1 * | 7/2002 | Kirmse et al. | 463/42 |
| 2003/0148812 | A1 | 8/2003 | Paulsen et al. | |
| 2003/0177187 | A1 * | 9/2003 | Levine et al. | 709/205 |

FOREIGN PATENT DOCUMENTS

| | | | |
|---|---|---|---|
| JP | 2002-315959 | A1 | 10/2002 |
| JP | 16-105671 | A | 4/2004 |
| KR | 2001-0007698 | A | 2/2001 |
| KR | 2002-0039909 | A | 5/2002 |
| KR | 2004-0009932 | A | 1/2004 |
| WO | WO 03-032127 | A2 | 4/2003 |

OTHER PUBLICATIONS

Cubist Co.,Ltd., PSO Fantasy Star Online Episode I & II—Ultimate system story Book, Jun. 27, 2003, Inaba Tosio. See Features (pp. 11, 17 and 37).

Sony, Playstation vol. 8, No. 11 finalfantasy XI, May 31, 2002,Chkada Masami. See Features (pp. 16-29).

Web+DB Press vol. 11, Nov. 15, 2008, Cataoka Sikelu. See Features (pp. 126-133).

* cited by examiner

*Primary Examiner* — Peter DungBa Vo
*Assistant Examiner* — Steve Rowland
(74) *Attorney, Agent, or Firm* — H.C. Park & Associates, PLC

(57) ABSTRACT

The present invention relates to a method and an online game system for providing position information of a game character in an online game, and more particularly, to a method and an online game system for providing position information of a game character in an online game by interworking with a predetermined messenger server.

22 Claims, 11 Drawing Sheets

- Prior Art -

METHOD FOR PROVIDING LOCATION INFORMATION OF GAME CHARACTER BY OPERATING WITH MESSENGER SERVER AND SYSTEMS THEREOF

CROSS REFERENCE TO RELATED APPLICATIONS

This application is a U.S. National Application of International Application PCT Application No. PCT/KR2005/001323 filed on May 6, 2005, which claims the benefit of priority from Korean Patent Application No. 10-2004-0031586 filed on May 6, 2004. The disclosures of International Application PCT Application No. PCT/KR2005/001323 and Korean Patent Application No. 10-2004-0031586 are incorporated herein by reference.

TECHNICAL FIELD

The present invention relates to a method and an online game system for providing position information of a game character in an online game, and more particularly, to a method and an online game system for providing position information of a game character in an online game by interworking with a predetermined messenger server.

BACKGROUND ART

In a general online game environment, because only one game server processes signals over a wide game area, there are many problems in system ability or signal processing. To solve the problems, various data distribution methods appear and are performed.

A representative one of conventionally introduced data distribution methods is, for example, a method in which a game area is divided into zones according to a standard and an exclusive game server is allocated to the divided zone, thereby inducing data distribution.

In the data distribution process by using the division of zones and the exclusive game server, in case that a character of a client tries to know position information of another character in performing a game, broadcasting is performed on the exclusive game server with respect to at least one zone or present position information of all characters accessing the online game is recorded in a database. In case that a position information query is transmitted, the present position information of the character is searched with reference to the database. Therefore, heavy load is on processing of the game server and also a communication network.

Also, a conventional method of providing position information of a character in an online game remains within showing information of a certain local server that the character accesses but not showing accurate position information of the character accessing the online game. An example of a screen shot of a strategy simulation game whose name is StarCraft of Blizzard among conventional online games is illustrated in FIG. 1.

FIG. 1 is a diagram illustrating an example of providing character position information in an online game, according to a conventional method. Referring to FIG. 1, a first user inputs ID information of a second user which the first user tries to search in a command input blank 110, an online game server indicates whether the second user logs in the online game and provides to the first user 100. In this case, in case that the second user logs in the online game server, the name of the game server that the second user accesses may be indicated together. According to the method of providing position information in an online game, according to the conventional method, there are provided whether a user to be searched logs in a game server or name information of the game server that the user accesses. However, detailed information, for example, the user is located in which position in the online game, is not provided.

The position information providing method in an online game according to the conventional method is more required in Massively Multi-player Online Role Playing Game (MMORPG) in which a plurality of users access and perform a game than the described strategy simulation game. In conventional MMORPGs, there is no method of providing position information of another character. In conventional MMORPGs, loads on a game server is very heavy due to managing users accessing at the same time, which are general from several thousands to several tens of thousands. Satisfying the requirement of users for providing position information is not easy due to the load of server processing required in searching character position information and the load on a communication network required in providing position information to users.

Also, the conventional position information providing method in an online game has a problem in which a user trying to search position information of another user can not search the position information of the another user in case that the user does not log in the online game. That is, the requirement of the user is not satisfied, in which the user tries to obtain whether another user that the user tries to search accesses the online game or accurate position information of another user in the online game in a stat in which the user does not log in the online game.

Accordingly, it is increased the requirement with respect to an online game method and system which can reduce the load on a game server required in providing position information of a character in an online game, obtain position information of a certain character in a state in which a user does not log in the online game, and provide concrete position information in the online game, including whether the certain character logs in the online game.

DISCLOSURE OF INVENTION

Technical Goals

To solve the problems of the conventional method as described above, the present invention provides a method and an online game system which can search position information of a certain character in an online game.

The present invention also provides an online game method and system providing position information of a game character by interworking with a messenger server, which provides the position information by using P2P method, thereby reducing the load of a game server providing online game service and a communication network.

The present invention also provides an online game method and system providing position information of a game character by interworking with a messenger server, which provide the position information of the character by storing map data of an online game in a terminal of a user and transmitting present position information of a user via the messenger server, thereby providing more accurate character position information to the user.

The present invention also provides an online game method and system providing position information of a game character by interworking with a messenger server, which allows it to be possible that a user obtains position information of a certain character of an online game via the messenger server without login a game server, thereby providing the convenience of the user.

TECHNICAL SOLUTIONS

According to an aspect of the present invention, there is provided a method of providing position information of a character in an online game, including: a step of receiving a signal for requesting character position information of a second user from a messenger client of a first user; a step of transmitting a character position information query corresponding to the character position information request signal to a messenger client of the second user; a step of receiving a character position information response corresponding to the character position information query from the messenger client of the second user; and a step of transmitting the character position information response to the messenger client of the first user, wherein: the messenger client of the first user controls to process the character position information response and display the character position information of the second user on a terminal of the first user; and the messenger client of the second user receives the character position information of the second user from a game module of the second user.

According to another aspect of the present invention, there is provided a method of receiving position information of a character in an online game, including: a step of maintaining a game module for executing the online game in a storage means; a step of accessing a predetermined messenger server and maintaining a messenger client for communicating with at least one first user in the storage means; a step of transmitting a signal requesting character position information of a second user accessing a game server of the online game; a step of receiving a character position information response corresponding to the character position information request signal from the messenger client of the second user; and a step of processing the received character position information response and displaying character position information of the second user on a terminal of the first user, wherein the messenger client of the second user receives the character position information of the second user from a game module of the second user.

According to still another aspect of the present invention, there is provided an online game system providing character position information, including: a messenger server transmitting a second user character position information request signal received from a messenger client of a first user via communication between messenger clients of at least one user to a messenger client of the second user and transmitting a character position information response received from the messenger client of the second user to the messenger client of the first user; a map database in which predetermined static data required in performing the online game; and a game server controlling to perform the online game via communication between game modules of the at least one user and transmitting dynamic data required in performing the online game to the messenger server to perform data synchronization, wherein: the messenger client of the first user controlling to process the character position information response received from the messenger server and display the character position information of the second user on a terminal of the first user; and the messenger client of the second user operating to receive the character position information of the second user from a game module of the second user and transmit to the messenger server.

BEST MODE FOR CARRYING OUT THE INVENTION

Hereinafter, an online game method and system providing position information of a game character by interworking with a messenger server, according to the present invention are described with reference to the attached drawings.

Figure 1:
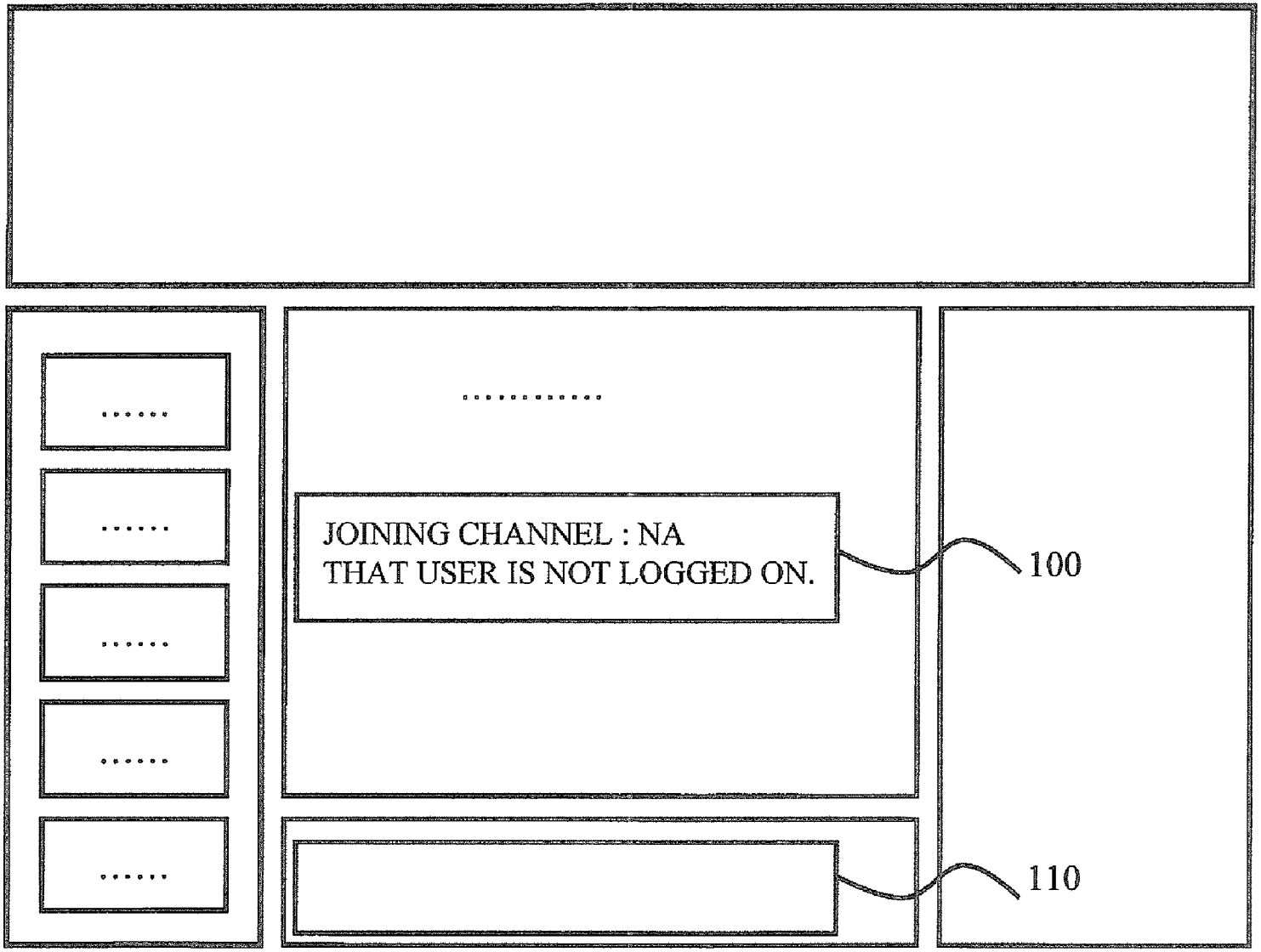
FIG. 1 is a diagram illustrating an example of providing character position information in an online game, according to a conventional method.
Figure 2:
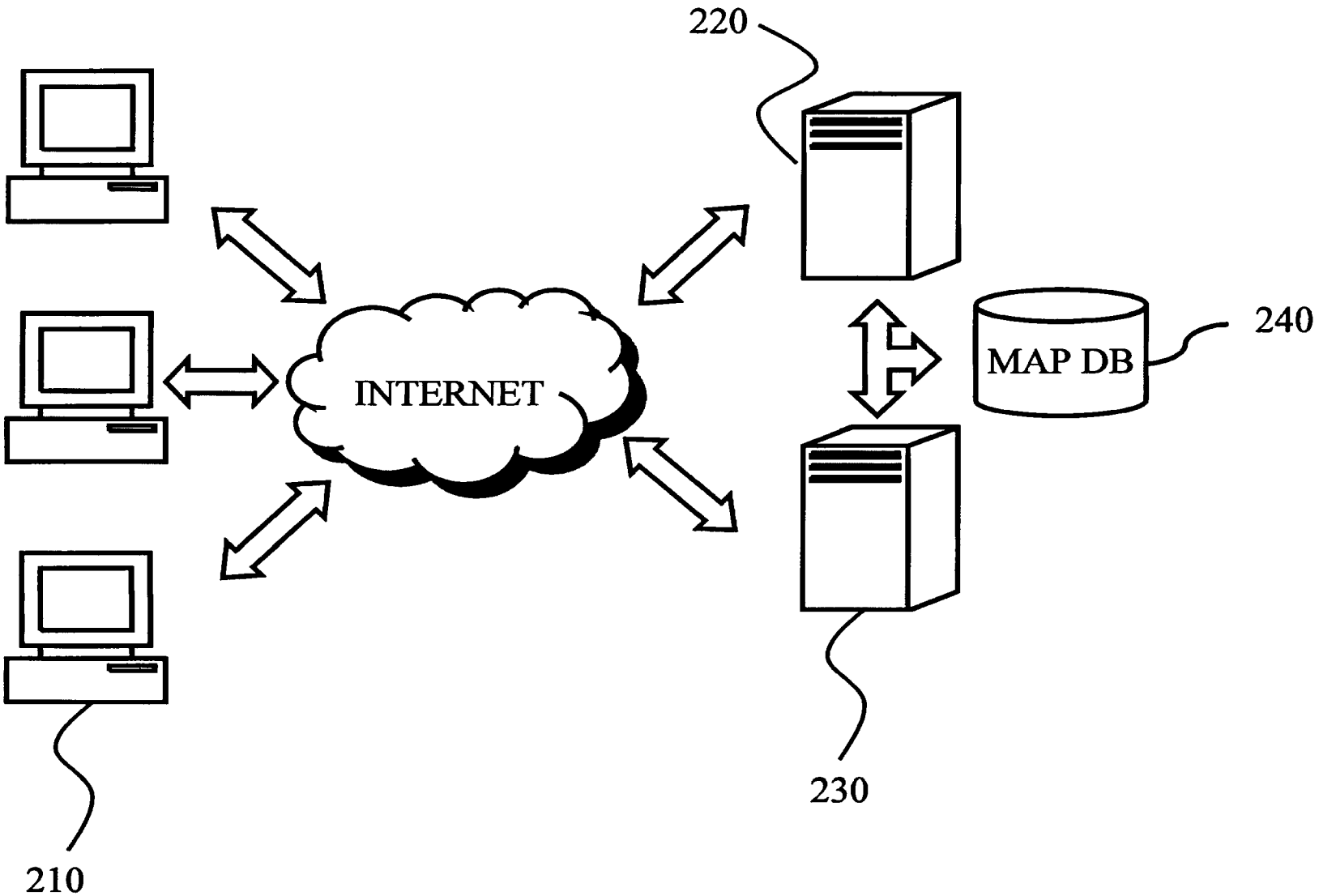
FIG. 2 is a block diagram illustrating the configuration of an online game system providing position information of a game character by interworking with a messenger server, according to the present invention.

FIG. 2 is a block diagram illustrating the configuration of an online game system providing position information of a game character by interworking with a messenger server, according to the present invention.

Referring to FIG. 2, the online game system according to the present invention includes a game server 220, a messenger server 230, and a map database 240, and at least one user terminal 210 is connected via a predetermined communication network.

The user terminal 210 indicates a terminal of an Internet user that receives online game service by receiving game data or game patch for implementing a game from the game server 220 in a contract with the user to provide predetermined game service via a communication network. The user terminal 210 is a device which maintains an access state with the game server 220 via a communication network such as Internet and telephone line to embody the online game, for example, a terminal with predetermined operation ability by including a predetermined memory means and equipping with a predetermined microprocessor, such as personal computers, handheld computers, Personal Digital Assistants (PDA), mobile phones, and smart phones.

In the map database 240, static data required in implementing online game service according to the present invention is recorded. Information for implementing the online game service according to the present invention may include static data and dynamic data. The static data indicates data which is not changed after beginning the online game service, such as map data, the name of places, names, numerical information for distinguishing districts, which are required in the online game. Also, dynamic data indicates data continuously changed, such as castles, guild information of a district generated in performing MMORPG. In the online game system according to the present invention, the static data is recorded in the map database 240, and the game server 220 and messenger server 230 may access the map database 240 and obtain the static data required in implementing the online game or providing character position information.

The game server 220 provides the online game service via the at least one user terminal 210 and may include at least one zone server controlling user access management and game implementing with respect to at least one zone. The game server 220 is connected to the user terminal 210 via a communication network and may indicate a game server providing game service online to users in a predetermined contract, such as Multiple User Dialogue (MUD) game servers and Multiple User Graphic (MUG) game servers. In the game service provided by the game server 220, in case that a game module installing a program associated with the game accesses the game server 220 according to the present invention, predetermined game implementing data or game patch data is transmitted to a terminal means and the game implementing is supported to be performed by using a user character controlled by the game module. The detailed description of the game server 220 will be described later with reference to FIG. 3.

The messenger server 230 performs communication between messenger clients of at least one user and may be a messenger server designed similar to a conventional messenger server such as MSN of Microsoft or a messenger server particularly designed for providing the character position information according to the present invention. The messenger server 230 according to the present invention fetches static data required in providing the character position information and obtains dynamic data required in providing more accurate character position information via communication with the game server 220, thereby providing the character position information in an online game via the messenger clients of the at least one user. The detailed description of the messenger server 230 will be described later with reference to FIG. 3.

Figure 3:
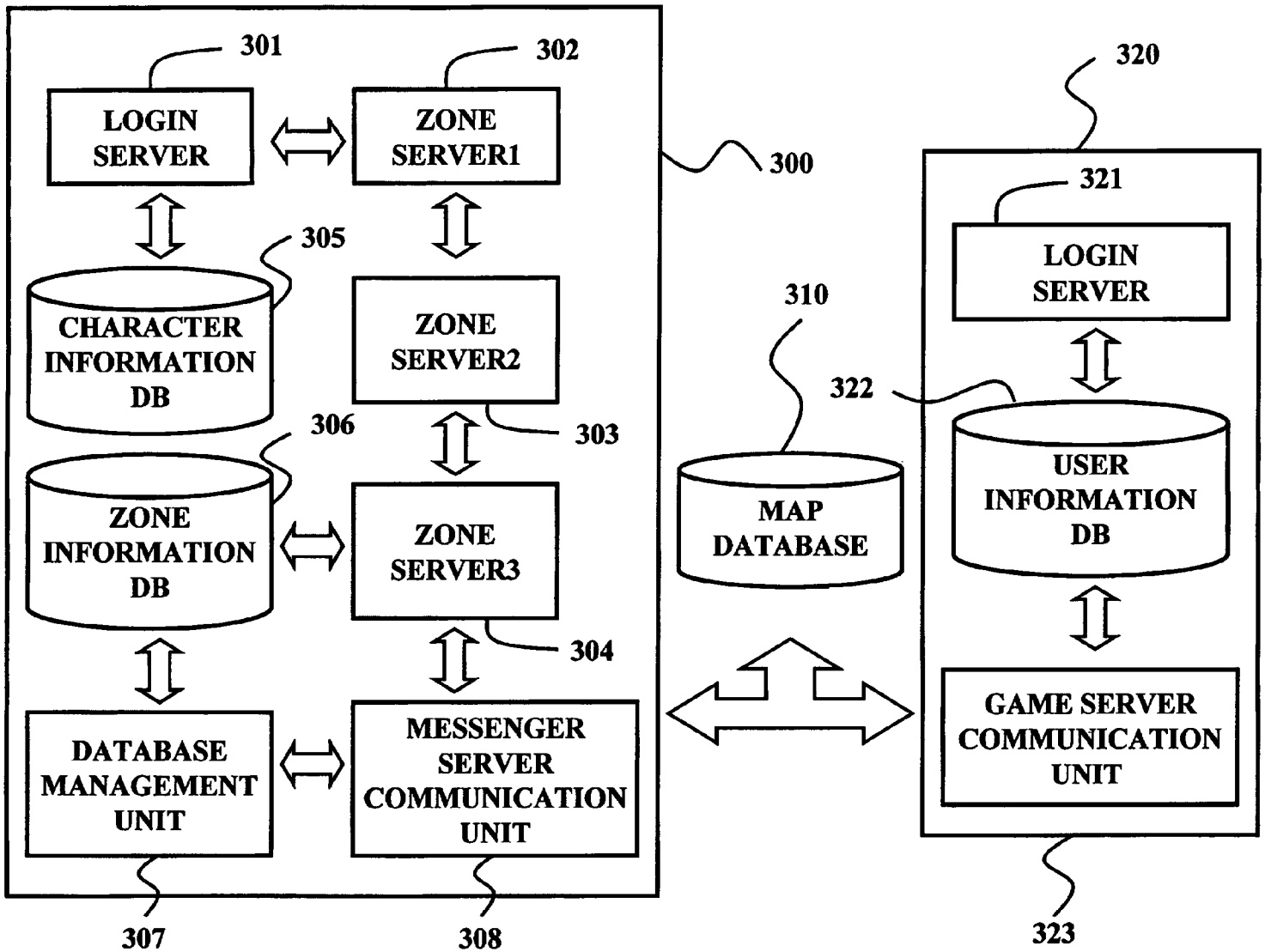
FIG. 3 is a block diagram illustrating the configuration of a game server and a messenger server according to an embodiment of the present invention.

FIG. 3 is a block diagram of the configuration of the game server and the messenger server according to an embodiment of the present invention.

Referring to FIG. 3, the game server 300 according to the present invention may include a login server 301, at least one zone server 302 to 304, a character information database 305, a zone information database 306, a database management unit 307, and a messenger server communication unit 308. The messenger server 320 may include a login server 321, a user information database 322, and a game server communication unit 323.

The login server 301 of the game server according to the present invention manages an access of a game user. A game user is authenticated via login ID and password inputted by the game user, and the login record of the game user is managed. According to embodiments, the login server 301 may perform billing with respect to the game service provided to the game user by interworking a predetermined billing server (not shown).

The zone servers 302 to 304 are configuration modules which divide game map data "world" required in progressing game in the game server into the size of a predetermined area, define at least one zone, and control performing the online game. The zone may be subdivided into at least one cell.

In FIG. 3, the game map data is divided into three zones and three zone servers 302 to 304 allocated to each zone are illustrated. As described above, the zone may set up by a manager of the online game system according to the present invention in the size and number. A command process is limited in per zone and distributed data processing is performed. In this case, the command processing indicates signal processing to perform the game implementing via handling a certain user character according to a command signal of the user. For example, as the command process which may be generated in the zone, there are a process associated with controlling user character handling such as moving the user character and attacking a certain monster according to the control handling received from a user game module and a process in which background things such as trees, buildings, and goods or other characters such as monsters, other user characters, and NPC are shown as changed according to movement of the user character.

In the character information database 305, information on a character performing the online game according to the present invention is recorded. An example of the configuration of a table of the character information database 305 is illustrated in FIG. 4.

Figure 4:
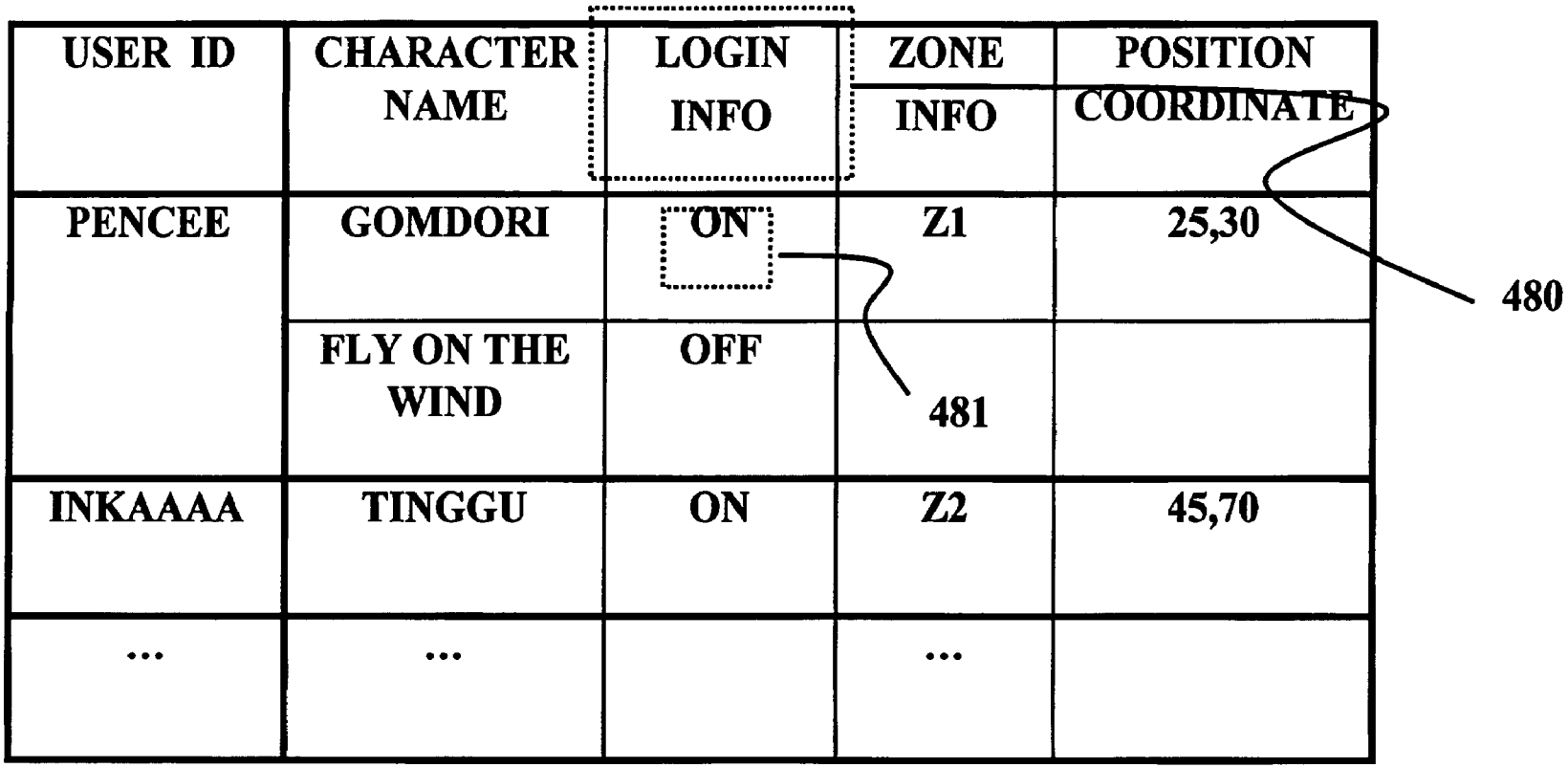
FIG. 4 is a block diagram illustrating an example of a character information database table included in the game server according to an embodiment of the present invention.

FIG. 4 is a diagram illustrating an example of a character information database table included in the game server according to an embodiment of the present invention. Referring to FIG. 4, in the character information database 305 of the game server 300 of the online game system according to the present invention, user IDs, character names, login information, information on the zone server implementing the command process with respect to a present character, and position coordinate information of the present character may be recorded.

Login information 480 indicates whether a user logs in the online game system according to the present invention in case that the online game system provides character position information of a certain user. In case that the login information is ON 481, it is indicated that the character of the user logs in the online game system. In the online game system according to the present invention, the user may possess at least one character corresponding to one user ID, which is embodied by selecting a character played by the user via communicating with the login server 301 in case that the user logs in the online game system 300 according to the present invention.

In the zone information database 306, information on at least one zone divided by the design of a system manager in an online game is recorded. The zone information database 306 manages information on a user character positioned in the zone and an item and monster generated or disappeared from the zone via communicating with the at least one zone server 302 to 304.

The database management unit 307 manages the character information database 305 and the zone information database 306 of the game server 300 according to the present invention. The database management unit 307 may be embodied by using relational database management system RDBMS such as Oracle, Infomix, Sybase, and DB2 or object-oriented database management system such as Gemston, Orion, and O2.

The messenger server communication unit 308 is in charge of interfacing in order to communicate with the messenger server 320 according to the present invention. In case that static data is updated in the game server 300, the messenger server communication unit 308 not only records the updated static data in the map database 310 but also periodically or aperiodically transmits dynamic data required in performing a game, thereby performing data synchronization between the game server 300 and the messenger server 320.

The login server 321 of the messenger server 320 receives an access request from a messenger client installed the at least one user terminal and manages the access of the user. A messenger user is authenticated via a login ID and password transmitted from the messenger client and manages login record of the messenger user. According to embodiments, the login server 321 may operate to provide various contents such as music and decorating an avatar to the messenger user by interworking with a predetermined contents providing sever (not shown).

In the user information database 322, information on a user trying to provide or receive character position information in the online game according to the present invention is recorded. An example of the configuration of a table of the user information database 322 is illustrated in FIG. 5.

Figure 5:
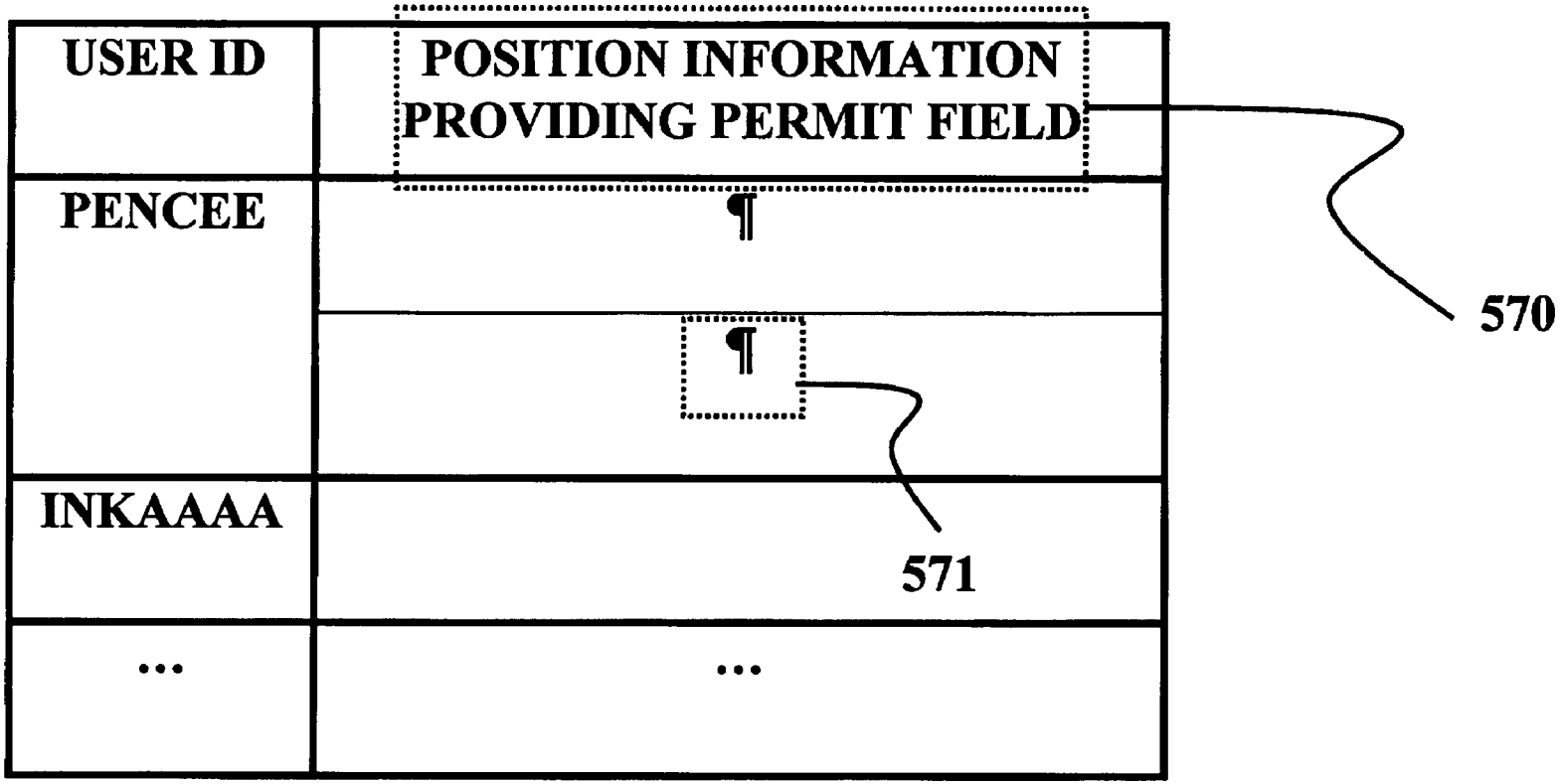
FIG. 5 is a diagram illustrating an example of a user information database table included in the messenger server according to an embodiment of the present invention.

FIG. 5 is a diagram illustrating an example of a user information database table included in the messenger server according to an embodiment of the present invention. Referring to FIG. 5, a user information database of the messenger server 320 according to the present invention includes a position information providing permit field 570 in addition to user basic information such as a user ID. In the position information providing permit field 570, a flag may be set up or cleared according to selection of the user. The position information providing permit field 570 shows whether the user provides position information of the user to another user in case that the another user requests providing position information of the user. For example, in case of user ID 'pencee', a permit flag 571 is set up in a position information providing permit field with respect to at least character.

Figure 6:
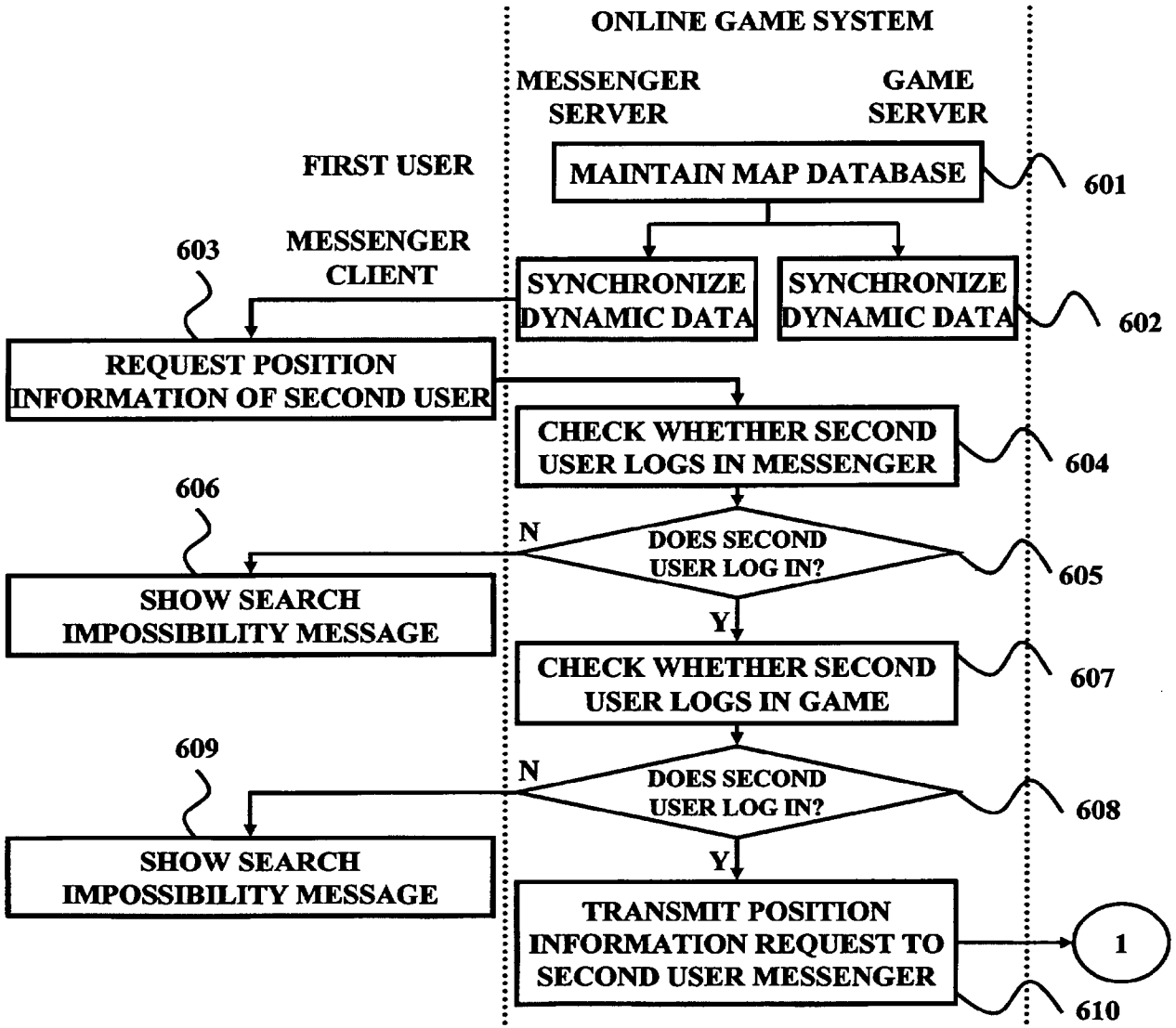
FIGS. 6 and 7 are flow charts illustrating an online game method providing position information of a game character by interworking with the messenger server, according to an embodiment of the present invention.
Figure 7:
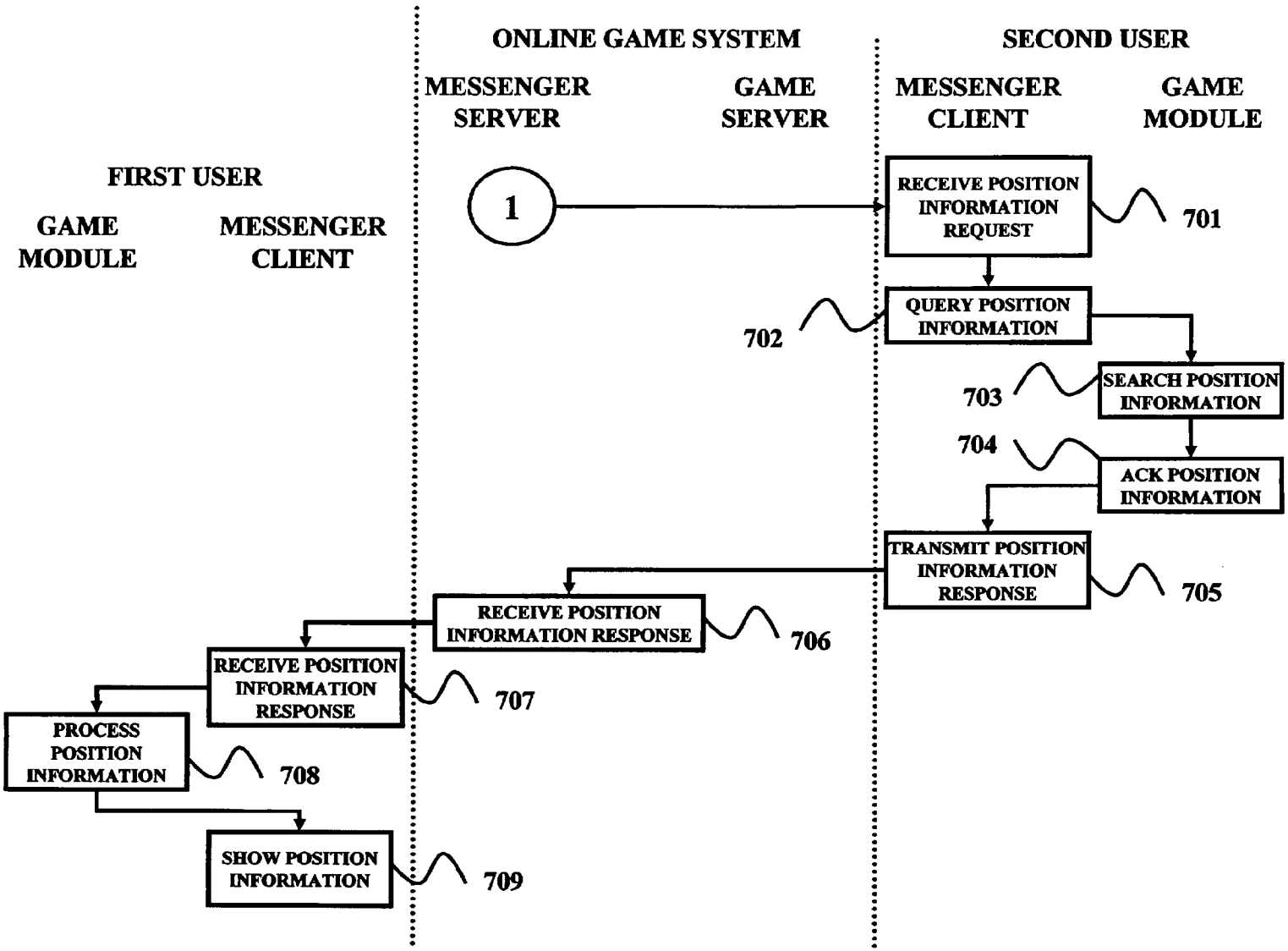

FIGS. 6 and 7 are flow charts illustrating an online game method providing position information of a game character by interworking with the messenger server, according to an embodiment of the present invention.

Referring to FIG. 6, the online game method providing position information of a game character by interworking with the messenger server, according to an embodiment of the present invention, may include following steps.

The online game system according to the present invention includes a map database (Step 601). As described above, in the map database, static data required in performing the online game service according to the present invention is recorded. For example, the static data is data that is not changed after beginning the online game service, such as map data required in the online game, place names, names, numerical information for distinguishing districts.

A messenger server and game server of the online game system according to the present invention performs synchronization of dynamic data that is continuously changed, such as castles and guilds generated in performing the online game (Step 602). The synchronization may be performed by fetching the dynamic data stored in a record means of the game server.

The static data or the dynamic data of Steps 601 and 602 may be recorded in a record means of a user terminal when the user accesses the game server or messenger server.

A first user that tries to search character position information of a predetermined second user transmits a second user position information request to the messenger server via a messenger client (Step 603). The messenger server receiving the request checks whether the second user logs in the messenger server (Steps 604 and 605) and checks whether the second user logs in the online game in case that the second user logs in the messenger server (Steps 607 and 608). Steps 604 and 605 may be embodied to determine whether the user logs in via a login server. Also, Steps 607 and 608 may be embodied to determine whether the user logs in by searching a login information field of a character information database of the game server.

In case that the second user is determined not to log in the messenger server in Step 605, a message in which the position information of the second user is impossible to be searched due to a block of the second user is transmitted to the messenger client of the first user (Step 606).

Also, in case that the second user is determined not to log in the game server in Step 608, a message in which the second user does not access the game server is transmitted to the messenger client of the first user (Step 609).

In case that the second user is determined to access the game server according to the present invention in Step 608, the position information request received from the first user is transmitted to a messenger client of the second user (Step 610).

Referring to FIG. 7 following FIG. 6, the online game method providing position information of a game character by interworking with a messenger server, according to the present invention may include following steps.

The messenger client of the second user receives the position information request transmitted in Step 610 of FIG. 6 (Step 701) and transmits a position information query of a game character of the second user to a game module installed in a terminal of the second user (Step 702). The game module of the second user searches present position information of the second user (Step 703) and transmits an acknowledgement ACK including the searched present position information of the second user to the messenger client (Step 704). The messenger client of the second user transmits a position information response including the position information to the messenger server (Step 705). The messenger server receiving the response transmits the position information response to the messenger client of the first user (Step 706). The messenger client of the first user receives the transmitted position information response (Step 707) and transmits the position information to a game module of the first user. The game module of the first user processes the transmitted position information (Step 708) and may show the present position information of the second user to the first user in various forms (Step 709).

In Step 709, a method of indicating the position information may be largely divided into (1) indication based on text and (2) indication using graphic user interface GUI. The indication method may be subdivided into indication based on static data and indication based on dynamic data.

The indication based on text processes the position information of the second user with predetermined geographical information to as text format and provides to the first user. For example, the position information may be provided as 'fly on the wind is at 28, 83, in rain town'

The indication using graphic user interface GUI processes the position information of the second user with predetermined map data as graphic user interface and provides to the first user. The position information may be provided by a method of showing the present position of the character of the second user to be distinguished in the map data by using the map data stored in a storage means of the user terminal of the first user and the position information, such as coordinate information, transmitted from the messenger client of the second user.

The indication based on static data may indicate a method of providing position information based on place names and coordinate information which are not changed in performing the online game. The indication based on dynamic data may indicate a method of providing position information including castles or guilds which are continuously changed data. For an example of the indication based on dynamic data, there may be 'fly on the wind is at 28, 83, manda town in a dominion of rainbow guild.'

Geographical information such as zone information, cell information, name information of the cell, and coordinate information of base point of the cell or map data for providing to the first user by processing the position information are previously recorded in the storage means of the user terminal. The first and second users transmit and receive position information via the messenger client. The position information is processed based on the geographical information or map data and shown in the user terminal. Therefore, the load of the game server for providing character position information can be reduced.

Figure 8:
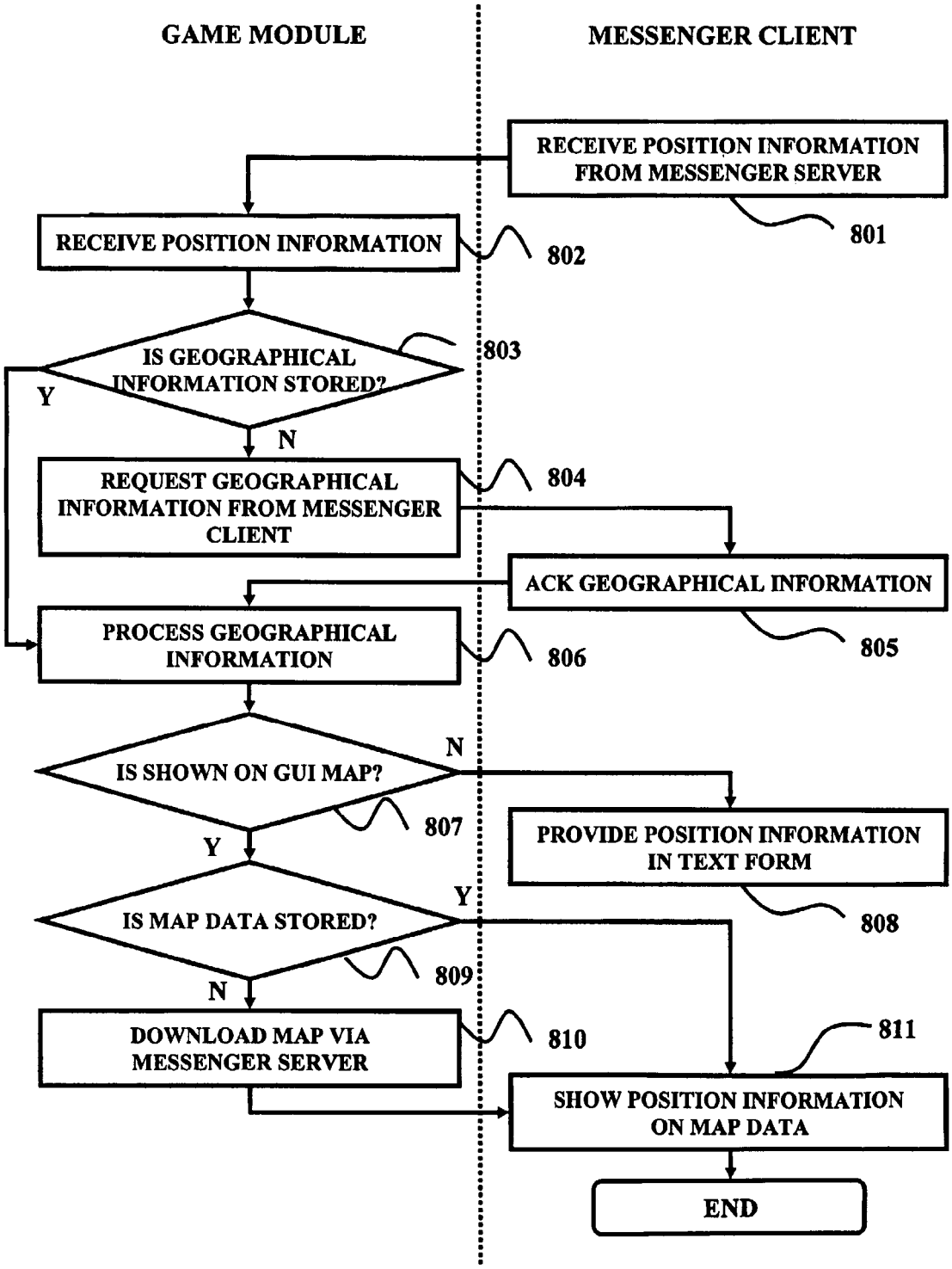
FIG. 8 is a flow chart illustrating an example of a position information processing method in which position information provided to a terminal of a user is processed to be shown to the user according to an embodiment of the present invention.

FIG. 8 is a flow chart illustrating an example of a position information processing method in which position information provided to a user terminal is processed and indicates to the user.

Referring to FIG. 8, the method of processing position information provided to a user terminal and indicating to the user may include following steps.

The messenger client of the first user receives the position information response transmitted from the messenger client of the second user (Step 801). The received position information is transmitted to the game module (Step 802). The game module determines whether geographical information is stored in the storage means of the user terminal (Step 803). In case that the geographical information is determined not to be stored in the storage means of the user terminal in Step 803, the game module requests the geographical information to the messenger client (Step 804). The messenger client transmits an acknowledgement including the geographical information to the game module (Step 805). In Step 805, the messenger client may receive the geographical information from the messenger server and forward the transmitted geographical information to the game module.

In case that the geographical information is determined to be stored in the storage means of the user terminal in Step 803 or the geographical information is received from the messenger client in Step 805, the game module processes the position information by using the geographical information (Step 806). The procedure of processing the position information may be divided into (1) indication based on text or (2) indication based on GUI, as described above.

In Step 807, it is determined whether the position information is going to be indicated on GUI map. In case that the position information is not indicated on GUI map, the position information is provided in text form to the user via the messenger client (Step 808). In case that the position information is determined to be indicated on GUI map, it is determined whether map data for indicating on GUI map data is stored in the storage means of the user terminal (Step 809). In case that the map data is stored, the position information is indicated in a GUI form by using the map data (Step 811). In case that the map data is determined not to be stored in the storage means of the user terminal in Step 809, it is requested to the messenger client to transmit the map data and the map data may be received from the messenger server, similar to described Steps 804 and 805 (Step 810).

The whether the position information is indicated on GUI map in Step 807 is performed by setting up of the user or setting up system default according to embodiment of the position information providing method according to the present invention. That is, in case that the user wants the indication based on text, position information based on text may be indicated, and in case that the user wants indication on GUI map, position information based on GUI map may be indicated.

Figure 9:
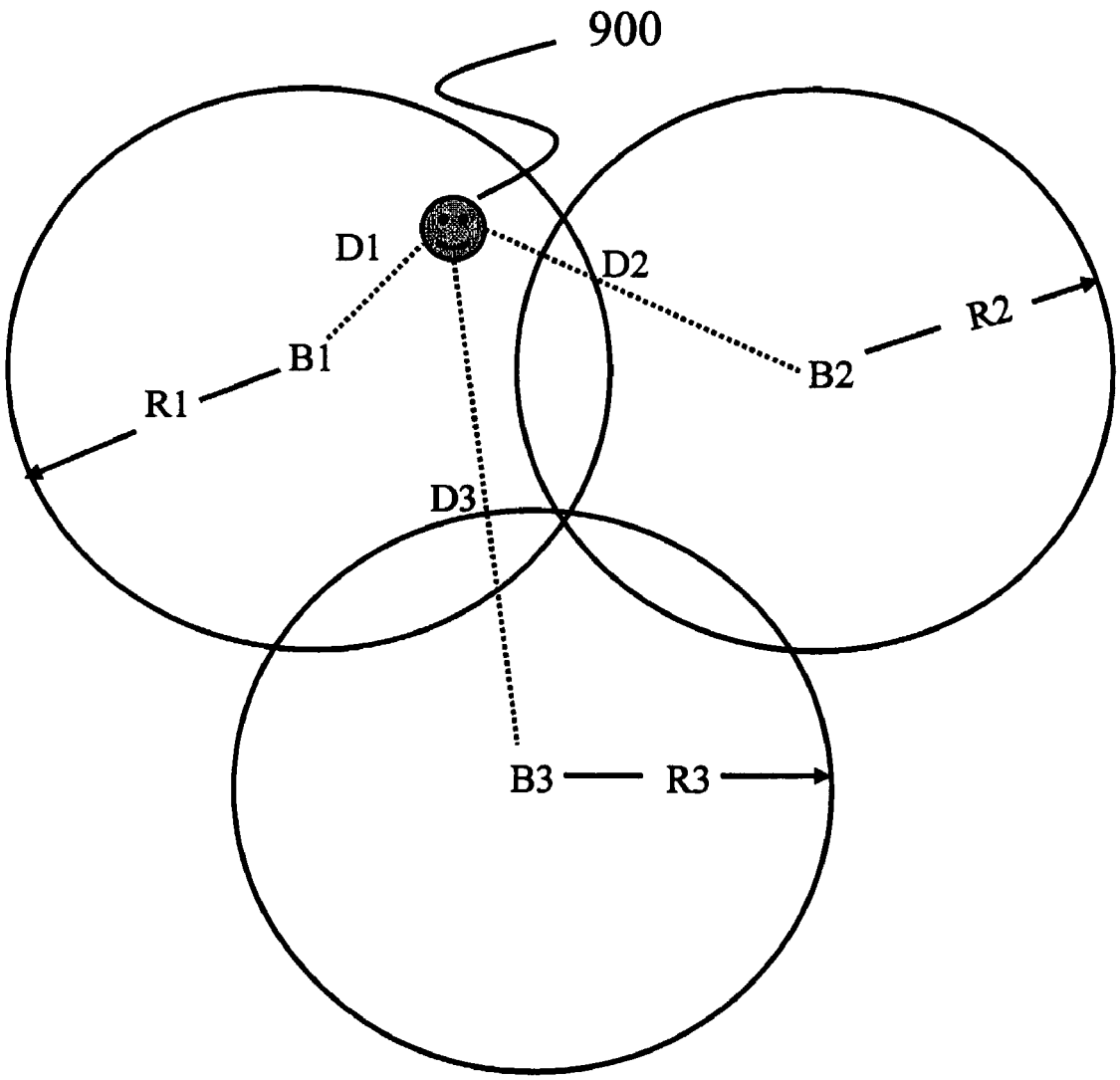
FIG. 9 is a diagram illustrating an example of the position information processing method for showing position information of a character accessing an online game according to an embodiment of the present invention.

FIG. 9 is a flow chart illustrating an example of a position information processing method for processing position information of a character accessing an online game, according to the present invention.

Referring to FIG. 9, name information of a certain cell, base points of the cell B1 to B3, radius information of the cell R1 to R3 are stored as geographical information in the user terminal of the first user. The position information transmitted from the messenger client of the second user is processed by using the geographical information and may provide the character position information in various forms to the first user.

For example, in case that position information formed of predetermined coordinate information is transmitted from the messenger client, the game module of the first user may operate a following operation by using the geographical information stored in the storage means of the user terminal. That is, distance information Dl to D3 between the coordinate information and at least one base points B1 to B3 are computed. The computed distance information D1 to D3 are compared with the radius information R1 to R3 of the cell to select a cell in which Dx<Rx. Referring to FIG. 9, in coordinate information 900 transmitted from the messenger client of the second user, a distance from the base point B1 is Dl. Since the computed D1 is D1<R1, a cell 1 may be selected. In case of the indication based on text, character position information may be indicated as "fly on the wind is at 28, 83 in kuwoo town", based on name information of the selected cell 1.

According to another embodiment of the present invention, in case that the cell in which Dx<Rx is at least one, the character of the second user is located around the boundary of at least one cell, the character position information may be indicated as the meaning in which the character is located around the boundary of the cells. In case that the cell in which Dx<Rx does not exist, the character of the second user is located outside an area divided into cells, the character position information may be indicated by using the name information of a cell with the shortest Dx.

Figure 10:
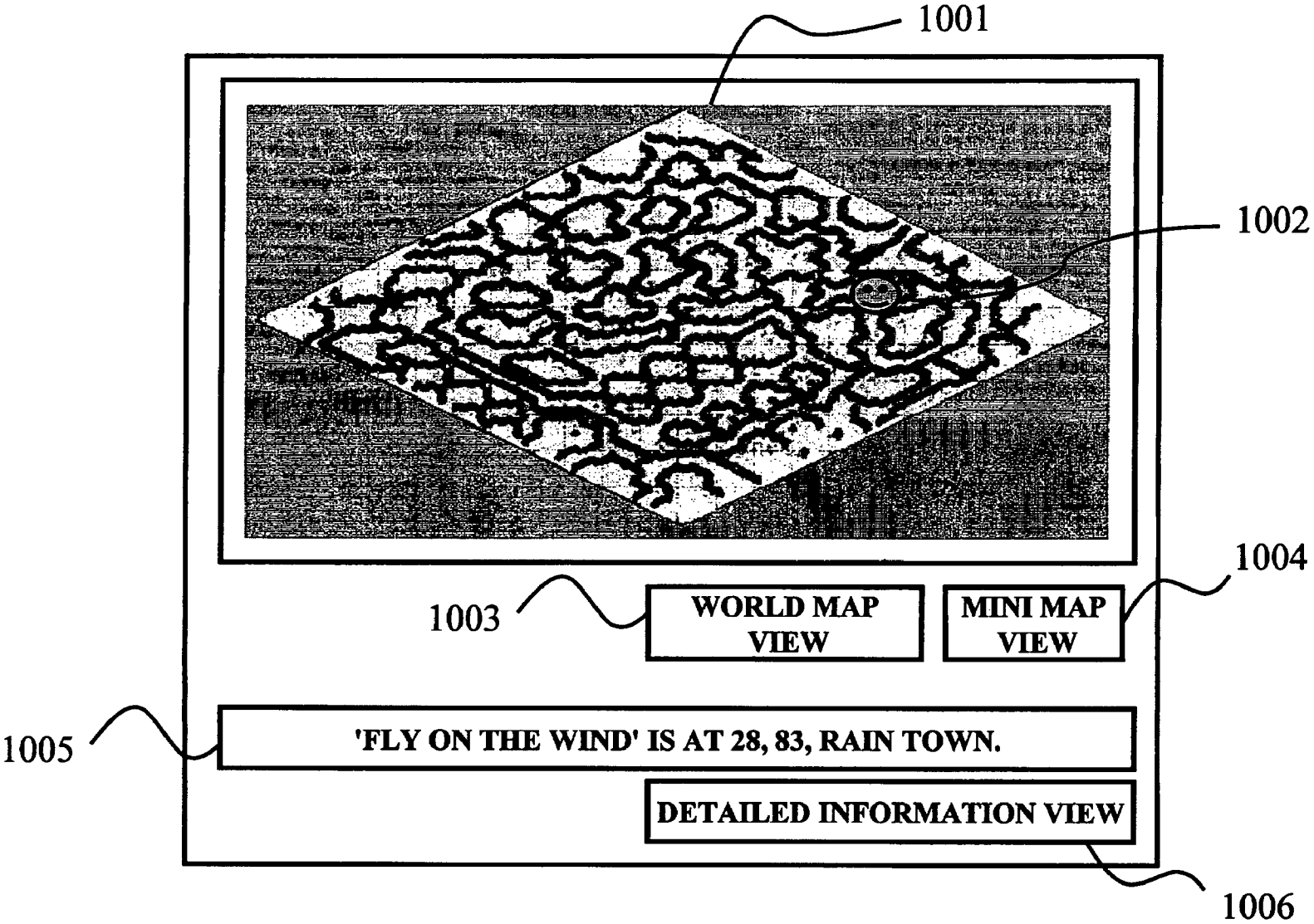
FIG. 10 is a diagram illustrating an example of a user interface providing position information of a game character according to the present invention.

FIG. 10 is a diagram illustrating an example of a user interface providing position information of a game character, according to the present invention.

Referring to FIG. 10, the user interface providing position information of a game character, according to the present invention may be formed of map data 1001, a character position information indication area 1002, map indication type selection buttons 1003 and 1004, a blank for providing position information in text form 1005, and a button for viewing detailed information 1006.

The map data 1001 and the character position information indication area 1002 may be shown in case that the user wants position information indication in GUI map data form or due to setting up system default, as described above. Also, map indication type selection buttons 1003 and 1004 may be a button with a function to enlarge or reduce a map. That is, in case that 'world map view' button 1003 is clicked, the map data may be macroscopically shown, and in case that 'mini map view' button 1004 is clicked, the map data may be microscopically shown.

Also, in the blank for providing position information in text form 1005, present position information of a certain game character may be indicated in text form. In case that the button for viewing detailed information 1006 is clicked, detailed position information including dynamic data, for example, 'fly on the wind is at 28, 83, rain town in a dominion of rainbow guild.', may be indicated.

Also, the embodiments of the present invention include a computer readable medium including a program instruction for executing various operations realized by a computer. The computer readable medium may include a program instruction, a data file, and a data structure, separately or cooperatively. The program instructions and the media may be those specially designed and constructed for the purposes of the present invention, or they may be of the kind well known and available to those skilled in the art of computer software arts. Examples of the computer readable media include magnetic media (e.g., hard disks, floppy disks, and magnetic tapes), optical media (e.g., CD-ROMs or DVD), magneto-optical media (e.g., floptical disks), and hardware devices (e.g., ROMs, RAMs, or flash memories, etc.) that are specially configured to store and perform program instructions. The media may also be transmission media such as optical or metallic lines, wave guides, etc. including a carrier wave transmitting signals specifying the program instructions, data structures, etc. Examples of the program instructions include both machine code, such as produced by a compiler, and files containing high-level languages codes that may be executed by the computer using an interpreter.

Figure 11:
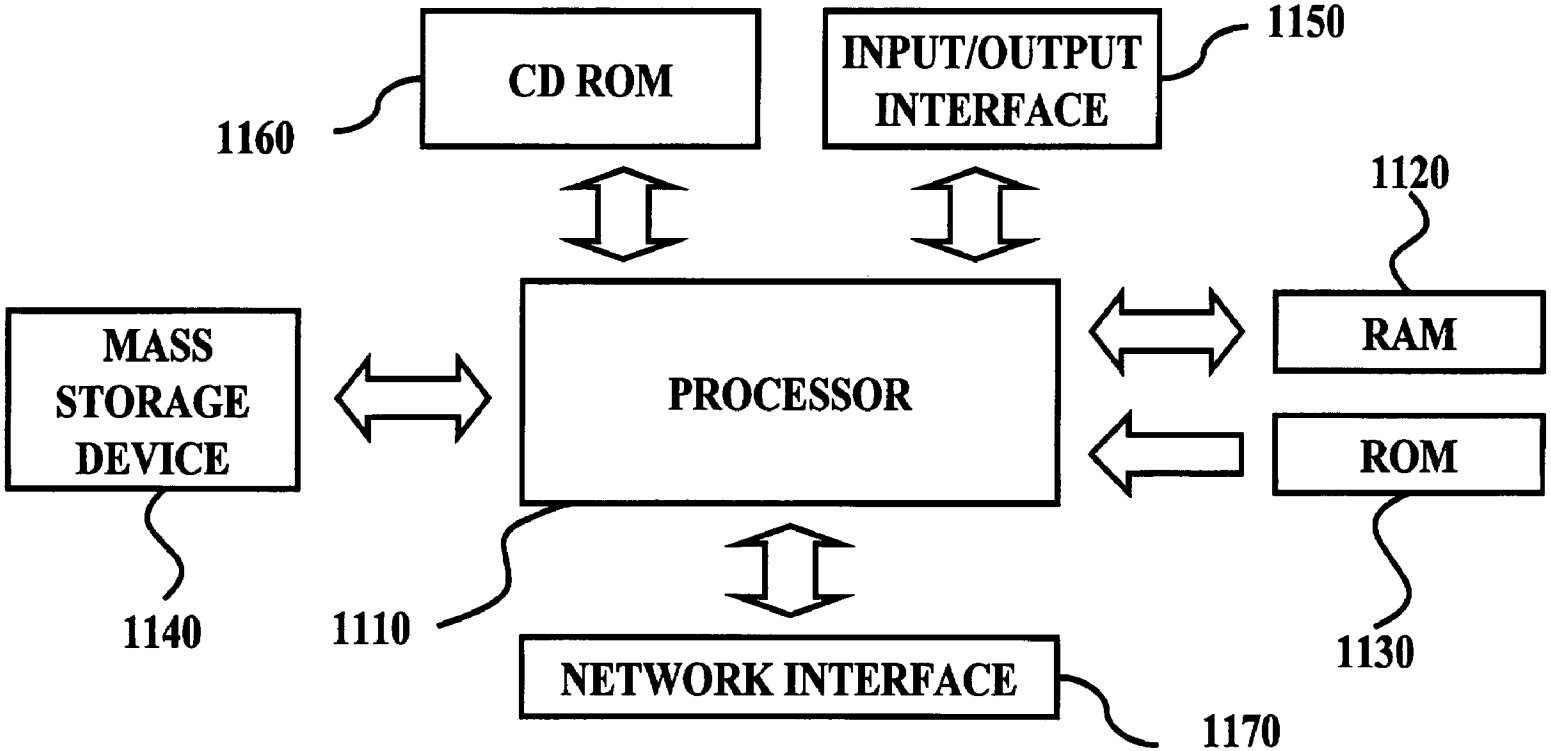
FIG. 11 is a block diagram illustrating the inside of a general use computer apparatus, which can be employed to the online game system providing the position information of the game character by interworking with the messenger server, according to the present invention.

FIG. 11 is a block diagram of the inside of a general use computer apparatus which can be employed to the online game system providing position information of a game character by interworking a messenger server, according to the present invention.

A computer apparatus 1100 includes at least one processor 1110 connected to a main memory device including a RAM (Random Access Memory) 1120 and a ROM (Read Only Memory) 1130. The processor 1110 is also called as a central processing unit CPU. As well-known to the field of the art, the ROM 1130 unidirectionally transmits data and instructions to the CPU, and the RAM 1120 is generally used for bidirectionally transmitting data and instructions. The RAM 1120 and the ROM 1130 may include a certain proper form of a computer readable recording medium. A mass storage device 1140 is bidirectionally connected to the processor 1110 to provide additional data storage capacity and may be one of the computer readable recording medium. The mass storage device 1140 is used for storing programs and data and is an auxiliary memory. A particular mass storage device such as a CD ROM 1160 may be used. The processor 1110 is connected to at least one input/output interface 1150 such as a video monitor, a track ball, a mouse, a keyboard, a microphone, a touch-screen type display, a card reader, a magnetic or paper tape reader, a voice or hand-writing recognizer, a joy stick, and other known computer input/output unit. The processor 1110 may be connected to a wired or wireless communication network via a network interface 1170. The procedure of the described method can be performed via the network connection. The described devices and tools are well-known to those skilled in the art of computer hardware and software.

The described hardware devices may be formed to be operated by at least one software module in order to perform the operations of the present invention.

While this invention has been particularly shown and described with reference to preferred embodiments thereof, various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, there is an effect of providing a method and online game system which can search position information of a certain character in an online game.

Also, according to an online game method and system providing position information of a game character by interworking with a messenger server, according to the present invention, the position information is provided by using P2P method, thereby reducing the load of a game server providing online game service and a communication network.

Also, according to an online game method and system providing position information of a game character by interworking with a messenger server, according to the present invention, the position information of the character is provided by storing map data of an online game in a terminal of a user and transmitting present position information of a user via the messenger server, thereby providing more accurate character position information to the user.

Also, according to an online game method and system providing position information of a game character by interworking with a messenger server, according to the present invention, it to be possible that a user obtains position information of a certain character of an online game via the messenger server without login a game server, thereby providing the convenience of the user.

The invention claimed is:

1. A method using a processor, the method comprising:

receiving a request for position information of a plurality of game characters corresponding to one or more game players using a game server comprising the processor via a network, the game players comprising a first player corresponding to a first client messenger of a first user terminal and a second payer corresponding to a second client messenger of a second user terminal, the request requested by the first user terminal with respect to a position information of the game characters corresponding to the second user, wherein a memory of a server, coupled to the processor, is configured to store the position information;

transmitting the request to the second client messenger, wherein the first client messenger and the second client messenger are coupled to an instant messenger server via the network;

receiving the position information of the characters corresponding to the second user via the second client messenger the position information comprising at least one of text data, map data, or text data and map data; and determining whether the received position information is text data or graphical data, wherein the position information is outputted according to the determination.

2. The method of claim 1, further comprising:

determining whether the second user accesses the instant messaging server via a messenger client; and transmitting the request for the position information of the characters corresponding to the second user to a messenger client of the second user according to the determination.

3. The method of claim 1, wherein the instant messaging server and the game server are coupled to a map database which stores static data associated with a multi-player game, and the instant messaging server fetches dynamic data associated with the multi-player game from the game server in order to synchronize data of the instant messaging server with data of the game server.

4. The method of claim 2, further comprising:

determining whether a search permit flag for the position information of the characters corresponding to second user is set up with reference to a database of the instant messaging server; and transmitting a search impossibility message in response to detection of the search permit flag not being set up.

5. The method of claim 1, further comprising:

transmitting the request from a messenger client of the second user to a game module of the second user;

searching for the position information; and transmitting the position information searched from the game module of the second user.

6. The method of claim 1, further comprising:

determining whether a response corresponding to the request is a text form or a graphic user interface form;

searching whether a predetermined map data being stored in a memory of the first user terminal in receipt of the position information of the map data associated with a graphic user interface form, wherein a request for the map data is transmitted to a messenger client and the position information of the map data transmitted from the messenger client of the first user is outputted according to the determination.

7. The method of claim 6, wherein the step of determining further comprises whether the response corresponding to the request is a text form or a map data form which is associated with the graphic user interface form, the text form or the map data form being outputted by the game module of the first user according to a selection by the first user.

8. A method using a processor for providing position information of a character on a virtual multi-player game space, the method comprising:

providing a game module coupled to the processor to execute an online multi-player game and providing a messenger client to communicate among users comprising a first user and a second user;

transmitting from the first user a signal requesting position information of a character corresponding to the second user;

receiving a response corresponding to the request from a messenger client of the second user, the response comprising position information of the character corresponding to the second user, the position information comprising at least one of text data, map data, or text data and map data; and determining, by the processor, whether a terminal of the first user is capable of displaying map data, wherein one of the position information of the character corresponding to the second user is selectively outputted to a terminal of the first user according to the determination.

9. The method of claim 8, further comprising:

searching base point coordinate information with respect to at least one zone area, radius information of the base point, or topographical information comprising name information of the zone area, wherein the position information of the character comprises position coordinate information of the character corresponding to the second user;

transmitting a request for the topography information to the messenger client in response to detection of the topography information not being stored;

receiving the topography information from the messenger client;

measuring a distance between the position coordinate information and the base point coordinate information;

selecting a distance shorter than the radius information corresponding to the base point coordinate information, of at least one of the measured distances; and displaying the name information of the zone area corresponding to the selected distance of the terminal of the first user.

10. A non-transitory computer-readable storage medium comprising a computer executable program, when executed by one or more processors, causes the one or more processors to perform the following steps:

receiving a request of position information of a plurality of game characters corresponding to one or more game players using a game server via a network, the game players comprising a first player corresponding to a first user terminal and a second payer corresponding to a second user terminal, the request requested by the first user terminal with respect to a position information of the characters corresponding to the second user, wherein a memory of a server is configured to store the position information;

transmitting the request to the second user terminal using an instant messenger server associated with an instant messaging system via the network;

receiving the position information of the game characters corresponding to the second user via the instant messaging, the position information comprising at least one of text data, map data or text data and map data of the characters corresponding to the second user; and determining, by the processor, whether the first user terminal is capable of displaying map data, wherein one of the text data, the map data, or the text data and the map data is outputted to the second user terminal according to the determination.

11. A game system for providing position information of a character associated with game space, the system comprising:

a messenger server configured to receive a request for position information of a character corresponding to one or more users, the users comprising a first user and a second user, wherein the request is requested by the second user from a messenger client of the first user via a network and the messenger server is further configured to transmit a response received from a messenger client of the second user to a messenger client of the first user, the response comprising position information of the character corresponding to the second user, wherein the first user and the second user play a multi-player game;

a map database configured to store static data for providing the online game service; and a game server configured to control the multi-player game via the network and to transmit dynamic data to the messenger server to synchronize the dynamic data, wherein the messenger client of the first user is configured to control the character position information received from the messenger server and to display the character position information corresponding to the second user, the character position information comprising at least one of text data, map data, or text data and map data, wherein it is determined whether the character information is text data or graphical data, and wherein the character position information is displayed according to a determination of whether the character information is the text data or graphical data.

12. The system of claim 11, wherein the game server comprises a login server configured to manage the access of the user and a zone server configured to maintain information of a zone; and the login server transmits an access information to the messenger server, and the messenger server transmits access information with respect to the accessing user to the messenger client of the second user.

13. The system of claim 11, wherein the messenger server further comprises a database in which identifier information with respect to the user and a search permit flag set up by the user is recorded; and if the request for position information of the character corresponding to the second user is received from the messenger client of the first user, the messenger server searches the search acceptance flag set up by the second user with reference to the database, and if the search acceptance flag is not set up or the second user does not access the game server, the messenger server transmits a search impossibility message to the messenger client of the first user.

14. The method of claim 2, wherein the messenger client of the second user receives the position information of the character corresponding to the second user from a game module of the second user.

15. The method of claim 1, further comprising:

controlling the position information of the second user by a messenger client of the first user.

16. A method using a processor for providing position information of a character of a virtual multi-player game space corresponding to a plurality of users comprising a first user and a second user, the method comprising:

receiving, via a network, from a messenger client of the first user a request for position information of a character corresponding to the second user, wherein a memory of a game server is configured to store position information of the game space corresponding to the respective users;

transmitting a query for the request to a messenger client of the second user using an instant messaging system via the network; and outputting, caused by the processor, a response corresponding to the query from the messenger client of the second user, the response comprising position information of the character comprising at least one of text data, map data, or text data and map data corresponding to the second user, the outputting comprising:

determining whether the position information is text data or graphical data; and outputting the position information according to a determination of whether the position information is the text data or graphical data.

17. The method of claim 16, wherein the messenger client of the second user receives the position information of the character corresponding to the second user transmitted from a game module of the second user.

18. The method of claim 16, wherein the messenger client of the first user controls the position information transmitted from the messenger client of the second user.

19. The method of claim 16, wherein transmitting further comprises determining whether the messenger client of the second user accesses the instant messaging server via a messenger client, and transmitting the query for the request to the messenger client of the second user in response to detection of the second user to access the game server.

20. The method of claim 16, wherein the messenger client of the second user transmits the query to a game module of the second user, and the game module of the second user searches position information with reference to a terminal storage of the second user and transmits the position information corresponding to the query.

21. A system, comprising:

a server comprising a processor configured to provide an online game via a network, wherein at least two nodes within the network are provided, each node comprising a messenger client, caused by the processor, configured to send instant messages and position information of a game character corresponding to one or more users, the position information comprising at least one of text data, map data or text data and map data, and wherein the processor is configured to route instant messages and the position information via the messenger client between the two nodes, wherein the server determines whether one of the nodes is capable of displaying map data, wherein one of the text data, the map data, or the text data and the map data is outputted to the node via the messenger client according to the determination.

22. The method of claim 1, wherein outputting further comprises determining, by the processor, whether the user terminal is capable of displaying map data, wherein one of the text data, the map data or the text data and the map data is outputted to the user terminal via the instant messaging according to the determination.

* * * * *